United States Patent [19]

Stasinski et al.

[11] 4,057,492

[45] Nov. 8, 1977

[54] ADJUSTMENT OF MOTION OF SCREENING MACHINE

[75] Inventors: David D. Stasinski, Forest Park; William E. Lower, Cincinnati, both of Ohio

[73] Assignee: Rotex, Inc., Cincinnati, Ohio

[21] Appl. No.: 697,318

[22] Filed: June 18, 1976

[51] Int. Cl.[2] ..... B07B 1/44

[52] U.S. Cl. ..... 209/366.5; 74/87; 209/367

[58] Field of Search ..... 209/363–367; 74/87

[56] References Cited

U.S. PATENT DOCUMENTS

| | | | |
|---|---|---|---|
| 756,950 | 4/1904 | Fraser et al. | 209/366.5 |
| 2,212,818 | 8/1940 | Stoltzfus | 209/332 |
| 2,596,281 | 5/1952 | O'Brien | 74/87 |
| 2,634,613 | 4/1953 | Dryg | 74/87 |
| 2,722,840 | 11/1955 | Kececloglu | 209/366.5 X |
| 2,747,418 | 5/1956 | Eckley | 74/87 |
| 2,915,183 | 12/1959 | Saxe | 209/367 |
| 3,478,406 | 11/1969 | Auckland | 209/334 |
| 3,504,793 | 4/1970 | Eaton et al. | 209/255 |

*Primary Examiner*—William A. Cuchlinski, Jr.
*Attorney, Agent, or Firm*—Wood, Herron & Evans

[57] ABSTRACT

The screening motion of a screening machine is changed by adding ballast, while the machine is in operation, to selected closed compartments moving with the vibrating assembly. In the preferred embodiment, the ballast is added through flexible tubing which is inserted through ports that close with spring loaded oil hole caps. When the tubing is pulled from the ports, the caps snap closed to capture the ballast in the selected compartments.

11 Claims, 3 Drawing Figures

ADJUSTMENT OF MOTION OF SCREENING MACHINE

Figure 1:
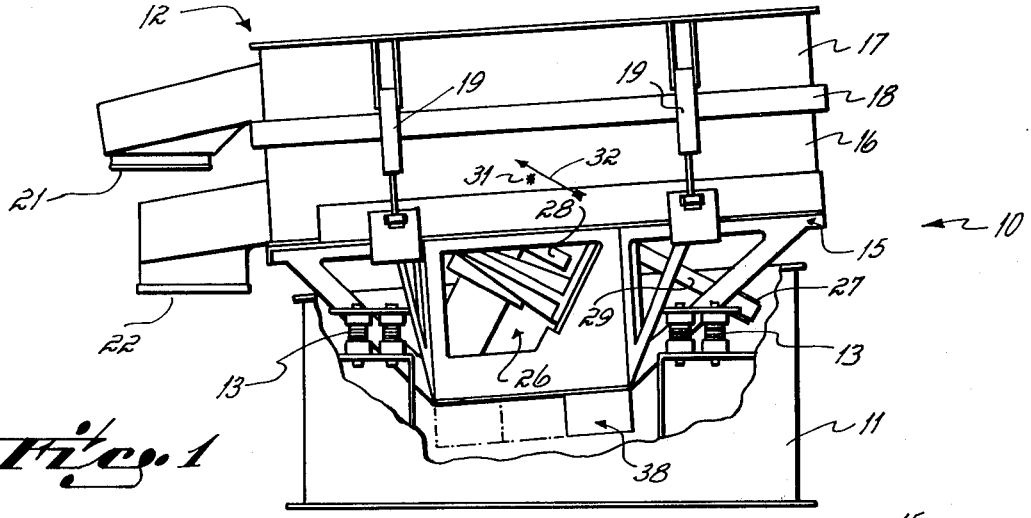

This invention relates to a method and apparatus for changing the screen motion of a screening machine while the machine is operating, by altering the positional relation of the center of gravity of the vibrating assembly with respect to the line of action of the excitation or driving force.

In a typical screening machine, the vibrating assembly (of which the screen itself is a part) is supported by a frame or a fixed base, and is driven in a path of screening motion, relative to the base, by a driving force. The driving force is often developed by a rotating eccentric.

For any given machine with a given type and flow of material on the screen, the screening characteristics, in terms of screening efficiency, conveying rate and path of flow across the screen surface, and so on, will depend upon and vary with the relationship between the center of gravity of the vibrating assembly, and the line of action of the excitation force which is applied to that assembly. The position of the center of gravity is the resultant of the weights and positions of the respective elements which comprise the vibrating assembly, and which are, of course, predetermined. In some types of screeners, the excitation force is intended to act on a line essentially through the center of gravity, to produce a planar form of screening motion. The plane of gyratory motion may be skewed to the plane of the screen surface in order to alter the conveying pattern of material passing over the screen, as shown in the U.S. Pat. to Simpson, No. 2,149,368. In other types of screeners the excitation force is substantially off-center (usually above or below center) with respect to the center of gravity, with the result that a second type of motion, a wobble or rotation about the center of gravity, is introduced, and may be in addition to planar screen motion. Each type of motion may empirically be found to have its advantages for different screening operations, and the "best" screening motion for making a particular operation can often be determined only by experiment.

For a given machine as manufactured, there is a predetermined or designed relationship between the center of gravity and the line of action of the exciting force. In practice this relationship is subject to manufacturing variables, and to changes that result from incorporation of optional or added features such as additional screen decks, baffles, feed boxes, etc. Moreover, apart from manufacturing variables, several unpredictable and inconstant factors come into play, including the nature, density, and distribution of the material being screened. These variables have the affect of changing the position of the composite center of gravity with respect to that of the unloaded machine, and hence change the screening motion.

In order to optimize the CG/force relation, common trial and error practices have included adding weights to the rotating eccentric and/or changing its position, thereby to change the excitation force, and adding weights to the vibrating assembly to change its center of gravity. At best, such techniques are crude, and they afford adjustment only in gross increments; moreover, they require stopping the machine, making the change, then starting up again and observing the results obtained, on a stop and go basis.

In accordance with the invention, a compartmentized closed hollow container or box is mounted to the vibrating assembly for movement with it, preferably at a position removed from the center of gravity. This container is internally subdivided into a plurality of separate individual compartments, each of which is provided with a port or opening for introducing small increments of mass, such as shot or heavy liquid, into it. The compartments within the container are preferably arrayed in two perpendicular directions, e.g., both in the lengthwise direction of the screen and in the crosswise direction as well. The container is preferably located at the maximum practical distance from the C.G., so that the addition of a small increment of weight will have a more significant effect on the C.G. By selectively adding ballast to one or more compartments spaced from the C.G. in the direction lengthwise of the screen, the center will be shifted in the longitudinal direction; and by adding ballast to a compartment which is spaced in the direction crosswise of the screen from the C.G., the center is shifted in the crosswise direction. By increasing the amount of ballast in one or more compartments, the position of the center of gravity can be lowered. The ballast (preferably shot) is confined within the respective compartments, so that it cannot move significantly and can be added precisely at positions selected to achieve the desired change.

It is a particular advantage of this invention that it provides for changing the position of the center of gravity of the vibrating assembly in small increments, while the machine is "on the run", so that the effects of the changes can be immediately observed, and without shutting down the machine to make the center of mass changes. In preferred form, the individual compartments are charged through ports which comprise spring loaded oil hole caps. For filling while the machine is running, filling hoses or tubes are first inserted into the respective compartments. The flexible tubes are led from the ballast compartments to a filling position external of the machine, where shot (or liquid, etc.) can be poured through them while the machine is operating. Changes in the flow pattern on the screen and the screening motion can be observed as mass is added selectively to the compartments. When a satisfactory flow pattern is observed as an efficient and widespread pattern of material across the screen, the filling tubes are then pulled from the ports whereupon the caps snap closed, to maintain the shot within the compartments.

THE PRIOR ART

U.S. Pat. No. 3,478,406 shows a screening machine in which a canister containing pellets is mounted above the center of the screen as part of the vibrating assembly. The pellets vibrate with the can when the machine runs, setting up a "random motion" component of screen motion which is said to be useful in eliminating blinding of the screen by finely divided materials. No multiple compartments are shown, nor means of any type for changing the amount of pellets in the canister as the machine is operating.

In U.S. Pat. No. 2,212,818, shot is sealed in the eccentric rotated by the motor. As the motor speed is increased the shot is thrown outwardly in the rotor by centrifugal force, in order to reduce high amplitude "bucking" motion during startup and stopping. The mass is in the rotor rather than on the vibrating assembly, and rotates with the eccentric, rather than with the screen. The patent lacks the concept of selectively compartmentalizing the added mass. Other patents show rotors filled with liquid or with movable weights for example U.S. Pat. Nos. 2,596,281; 2,634,617; 2,747,418, as part of the drive means, and consequently with a separate motion from that of the screen itself.

U.S. Pat. No. 2,915,183 shows a tube for adding liquid to the hollow rotating eccentric of the motor drive, thereby to change the mangitude of the driving force, while the operation is in progress. No compartmentalization is shown.

In U.S. Pat. No. 3,504,793 a hollow doughnut rests on top of the screen and is partially filled with water to permit solid material retained on the screen to pass underneath it while forming a dam that restricts the outward flow of liquid on the screen. No compartmentalization is shown, the liquid is permanently filled in the doughnut, and there is no provision for filling in operation. The purpose of the compartment is to restrict flow of the material being screened, not to change the machine's motion.

Figure 2:
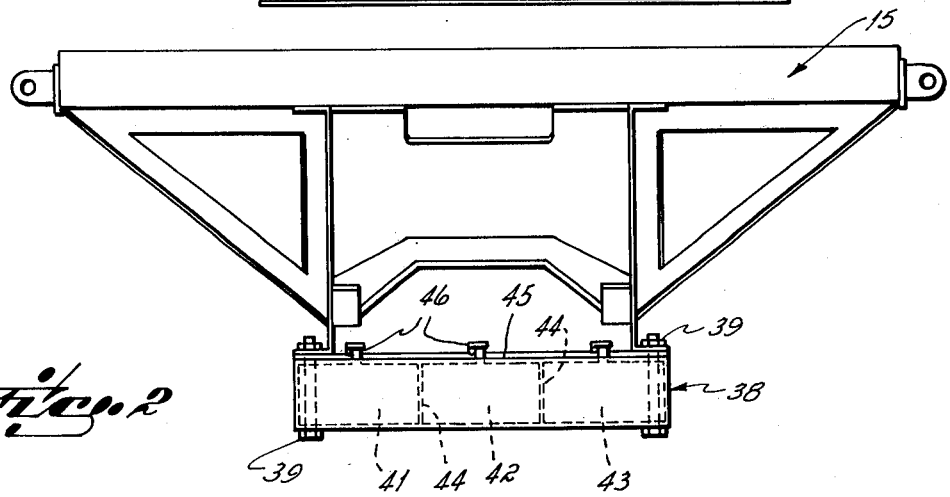
Figure 3:
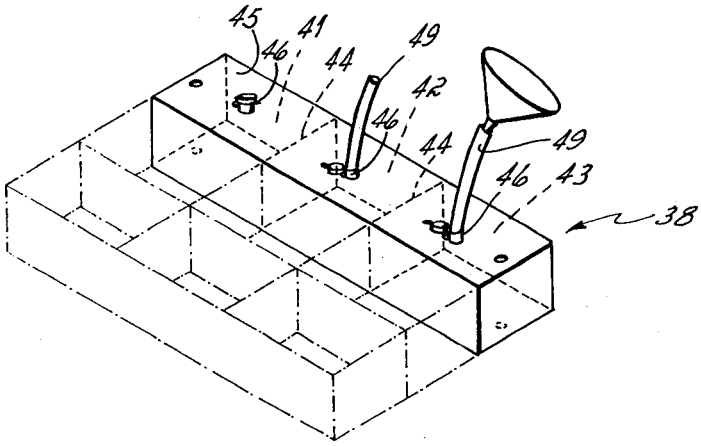

The invention can best be further described by reference to the accompanying drawings, in which, FIG. 1 is a side elevation, partly broken away, of a screening machine having a preferred embodiment of variable ballast in accordance with the invention mounted to it;

FIG. 2 is an enlarged end view of the screen table of the screening machine of FIG. 1, showing the ballast chamber, its mounting means and filling ports; and FIG. 3 is a perspective view, somewhat diagrammatic, illustrating the procedure for filling the ballast compartments, and illustrating in phantom lines a modified embodiment of the invention.

The variable ballasting means is useful with various different types of screening machines, and it should be understood that the particular screening machine itself is not the invention and that its configuration is not critical or limiting. The particular screening machine shown for purposes of illustration is a screener of the "Liquatex" type made by Rotex, Inc., Cincinnati, Ohio, as illustrated in design patent No. D-236,155.

The screener, designated generally by 10, includes a base 11 for floor mounting. The vibrating assembly 12 of the machine is mounted to base 11 by springs 13. Vibrating assembly 12 includes a screen table 15 (shown enlarged in FIG. 2), on which are seated lower and upper screen boxes 16 and 17 respectively. A screen frame, the edge of which is indicated at 18 in FIG. 1, is positioned between the lower and upper boxes 16 and 17. The two boxes and the screen are clamped in this stacked relation to the table 15 by suitable means, for example, over-center clamps as shown at 19 in the embodiment illustrated.

Vibrating assembly 12 moves as a unit when excited by the operating drive. The particulate feed is delivered by means not shown into the upper box 17, onto screen 18. Oversize particles which do not pass through the screen are delivered to an outlet chute 21, and fines which have passed through the screen are delivered to an outlet chute 22 (FIG. 1).

In the embodiment shown, the excitation force for driving the vibrating assembly 12 is supplied by a drive means indicated generally at 26, below the table 15. The drive means includes a motor not shown, mounted to frame 11, which turns a drive sheave at 27. Sheave 27 is connected by a belt 29 to drive a rotor or eccentric 28, which is journaled by and suspended below the vibrating assembly.

In this embodiment, the drive motor itself is mounted to the frame rather than the vibrating assembly, but it should be understood that the invention contemplates use of the ballasting means on screeners wherein the motor is mounted on the vibrating assembly.

The center of gravity of vibrating assembly 12 is indicated at point 31 in FIG. 1. The drive applies an excitation force indicated diagrammatically by the arrow 32, directed generally close to or through the center of gravity. (It will be appreciated by those skilled in the art that the instantaneous direction of the arrow 32 may change in operation, as the eccentric turns.) The motion of the screen will depend upon the precise positional relationship of the line of action 32 to the center of gravity 31. Thus it can be seen by reference to FIG. 1 that as the quantity of particulate materials on the screen 18 increases, this will shift the center of gravity upwardly from its position in the unloaded machine and thereby change the screening motion.

In order to alter and improve the relationship of the line of action of the excitation force and the center of gravity so as better to serve a specific screening operation, this invention provides a compartmentalized ballast container or chamber indicated at 38, mounted to the vibrating assembly. The container or chamber 38 is in the form of a box, internally divided into compartments (three compartments in the preferred embodiment shown), and secured by bolts 39 to the screen table 15. For the particular screener shown, it is convenient that the chamber 38 be mounted at the bottom of the frame, although this is not critical. Mounting the box spaced far from the C.G., as shown, insures that addition of a small unit of mass to the box will have a large effect on the position of the C.G.

As best shown in FIGS. 2 and 3, the ballast chamber 38 contains a plurality of individually openable and closable compartments, designated at 41, 42 and 43. For convenience the compartments 41–43 may be arranged in a plane parallel to the plane of the screen, side-by-side parallel to the width of the screen. The compartments 41–43 are separated from one another by internal walls or partitions as indicated at 44, and are closed at the top by a top plate 45.

Access to the interior of each compartment is provided through a separate port 46, which is desirably in the form of an oil hole cap having a spring-loaded cap member which is biased toward the closed position shown in FIG. 2. Such caps are known per se, and are sold by Gits Bros. Mfg. Co., 6385 W. 74th Street, Bedford Park, Ill. 60638.

Ballast may be added selectively to one or more or all of the compartments through the ports 46, as shown in FIG. 3. Ballast loading means preferably in the form of a length of rubber tubing, shown diagrammatically at 49, is inserted through the port and into the respective chamber, the tubing being sized to carry the shot, liquid or other mass units to be used as ballast. The outer or free end of each tubing 49 is led externally of the machine to a position from which the ballast can be charged through it (as by the funnel shown in FIG. 3) while the machine is running. As the ballast is added, its weight will change the position of the center of mass. This will have an affect on the screening movement, as observed in terms of the flow of the material as it is being screened, because a new relationship between the C.G. and the driving force is created. When the desired flow pattern has been achieved, the length of tubing 49 is simply pulled from its port, and the cap snaps closed so that the shot is captured in the chamber. Although there may be some movement of the mass within the chamber in operation, the chamber is not so large that such movement would adversely affect the screen motion.

In the preferred embodiment, three separate ballast compartments are provided. The addition of mass to the center compartment 42 has the primary affect of tending to lower the center of gravity but without shifting it to the left or right. The addition of shot to compartment 41 or 43 causes a sidewise shift, which may be desirable for example to compensate for offcenter feed, etc. Balanced addition of mass to all of the chambers will lower the center of gravity.

In the machine illustrated, the usual concern is with lowering the C.G., and for that reason the box is located below the C.G. However, need may arise to raise the C.G., and it is contemplated that the box can alternatively or additionally extend above the C.G.

In the preferred embodiment the compartments are aligned side-by-side, spaced in a single direction. In a modified embodiment of the invention, it is contemplated that the compartments may be arrayed in an X–Y arrangement, that is, both lengthwise and crosswise of the screen. This provides for the possibility of shifting the center of gravity in either of two perpendicular directions.

We claim:

1. In a screening machine including a base, a vibrating assembly resiliently supported by the base, said vibrating assembly including a screen, and drive means for applying an excitation force to said vibrating assembly to move it relative to said base so that the screen is moved in a pattern of screening movement, the screen being tiltable with respect to the base by the action of said excitation force on the vibrating assembly, means for changing said pattern of screening movement, comprising, a container presenting a plurality of enclosed separate hollow compartments within it, the container being secured to said vibrating assembly for movement with the vibrating assembly when the latter is vibrated by the drive means, the vibrating assembly having a center of gravity, the said compartments being fixed at different positions with respect to said center of gravity, each said compartment within said container having a closable port through which ballast can be selectively introduced into the respective compartment, the addition of such ballast into the compartment changing the relative position of the center of gravity of said vibrating assembly with respect to said excitation force, and thereby changing the pattern of screening movement by changing the tilting effect of said excitation force on said vibrating assembly.

2. The invention of claim 1 wherein said container includes a plurality of compartments which are arrayed in different directions with respect to the plane of said screen.

3. The invention of claim 1 wherein said drive means is connected to said vibrating assembly beneath said screen, and said container is mounted to said vibrating assembly beneath the point at which said drive means is connected to said vibrating assembly.

4. The invention of claim 1 wherein said compartments are arrayed in two mutually perpendicular directions.

5. The invention of claim 1 wherein the ballast comprises shot.

6. The invention of claim 1 wherein the ballast comprises heavy liquid.

7. In a screening machine including a base, a vibrating assembly movably supported by the base, said vibrating assembly including a screen, and drive means for applying an excitation force to said vibrating assembly to move it relative to said base so that the screen is moved in a pattern of screening movement, means for changing said pattern of screening movement, comprising, a container presenting a plurality of enclosed separate hollow compartments within it, the container being mounted to said vibrating assembly for movement therewith, the vibrating assembly having a center of gravity, the said compartments being arranged at different positions with respect to said center of gravity, each said compartment within said container having a closable port through which ballast can be selectively introduced into the respective compartment, the addition of such ballast into the compartment changing the relative position of the center of gravity of said vibrating assembly with respect to said excitation force, and thereby changing the pattern of screening movement, and ballast loading means for introducing said ballast into said compartments in small increments while said drive means is vibrating said assembly.

8. In a screening machine including a base, a vibrating assembly movably supported by the base, said vibrating assembly including a screen, and drive means for applying an excitation force to said vibrating assembly to move it relative to said base so that the screen is moved in a pattern of screening movement, means for changing said pattern of screening movement, comprising, a container presenting a plurality of enclosed separate hollow compartments within it, the container being mounted to said vibrating assembly for movement therewith, the vibrating assembly having a center of gravity, the said compartments being arranged at different positions with respect to said center of gravity, each said compartment within said container having a closable port through which ballast can be selectively introduced into the respective compartment, the ports having hinged caps which are spring biased closed, the addition of such ballast into the compartment changing the relative position of the center of gravity of said vibrating assembly with respect to said excitation force, and thereby changing the pattern of screening movement.

9. The invention of claim 8 further including a length of flexible hollow tubing selectively inserted into at least one of said ports, said tubing holding the spring loaded cap of said port open, said tubing being removable from said port while the machine is operating.

10. The invention of claim 8 wherein the port for each such compartment comprises an oil hole cap.

11. The method of changing the screening motion of a screening machine while the machine is in operation, comprising, providing a series of separately fillable compartments on a vibrating assembly of the machine, providing a closure for each said compartment which is biased closed, inserting a length of flexible tubing through at least one of said closures into the respective compartment, adding ballast to the respective compartment by pouring it through the tubing as the machine is operating, observing the changes in screening motion that accompany such addition of ballast, terminating the addition of ballast after a desired motion has been achieved, and pulling the tubing from the closure, the closure under its bias closing the port when the tubing is removed.

* * * * *